US008123090B2

(12) United States Patent
Missick

(10) Patent No.: US 8,123,090 B2
(45) Date of Patent: Feb. 28, 2012

(54) MULTI-HANGING POSITION TRANSPORTABLE ARTICLE HOLDER FOR MULTI-TYPE SEATING

(76) Inventor: Kenneth P. Missick, Fullerton, CA (US)

( * ) Notice: Subject to any disclaimer, the term of this patent is extended or adjusted under 35 U.S.C. 154(b) by 936 days.

(21) Appl. No.: 12/135,011

(22) Filed: Jun. 6, 2008

(65) Prior Publication Data

US 2008/0302840 A1 Dec. 11, 2008

Related U.S. Application Data

(60) Provisional application No. 60/942,400, filed on Jun. 6, 2007.

(51) Int. Cl.
*A47C 7/62* (2006.01)

(52) U.S. Cl. ..... 224/155; 224/153; 224/584; 224/642; 297/188.12; 297/219.1

(58) Field of Classification Search ..... 224/627, 224/628, 630, 633, 642, 427, 275, 576, 577, 224/153, 155, 584, 585, 581, 255; 297/228.1, 297/228.13, 219.1, 188.08, 188.12, 188.2
See application file for complete search history.

(56) References Cited

U.S. PATENT DOCUMENTS

| | | | | |
|---|---|---|---|---|
| 4,556,250 | A | 12/1985 | Chapman et al. | |
| 4,597,605 | A * | 7/1986 | Gilbert | 297/228.1 |
| 4,799,731 | A * | 1/1989 | Brown | 297/188.12 |
| 5,573,288 | A * | 11/1996 | Raffensperger | 297/188.12 |
| 5,816,463 | A * | 10/1998 | Echeverri | 224/584 |
| 5,894,977 | A * | 4/1999 | Krueger et al. | 224/627 |
| 5,988,465 | A * | 11/1999 | Vitale et al. | 224/155 |
| 6,079,599 | A * | 6/2000 | Nordstrom et al. | 224/153 |
| D474,934 | S * | 5/2003 | Ildstad et al. | D6/601 |
| 7,128,369 | B2 * | 10/2006 | Boggs et al. | 297/188.08 |

* cited by examiner

*Primary Examiner* — Justin Larson
*Assistant Examiner* — Corey Skurdal
(74) *Attorney, Agent, or Firm* — Knobbe Martens Olson & Bear LLP

(57) ABSTRACT

Disclosed is a combination backpack and seat cover apparatus which may be used with seats and benches without the need to use straps or buckles to hold the apparatus in place. A rigid, removable support for the apparatus is provided.

14 Claims, 8 Drawing Sheets

MULTI-HANGING POSITION TRANSPORTABLE ARTICLE HOLDER FOR MULTI-TYPE SEATING

CROSS-REFERENCE TO RELATED APPLICATIONS

This application relates to and claims the benefit of U.S. Provisional Application No. 60/942,400, filed Jun. 6, 2007, entitled "COMBINATION SEAT COVER AND BACK-PACK," the entire disclosure of which is incorporated herein.

BACKGROUND OF THE INVENTION

1. Field of the Invention

The present invention relates to seat coverings and article holders in general, and more particularly to a multi-hanging position transportable article holder for multi-type seating.

2. Description of the Related Art

The use of personal articles when attending a sporting event at a stadium or spending a day outdoors at the beach or park makes for a more enjoyable experience. A camera to capture moments, sunscreen for sunny outdoor games, or a blanket for chilly night games all add to the enjoyment of the experience. However, a safe and convenient place to store these personal items at such places is a problem. In addition, transporting personal articles in a carrier that must be held with one or both hands constrains the user's hands. When at a stadium, a spectator prefers to have both arms free to balance and guide himself when traversing the steep stairs and narrow rows to reach his seat. The user may require both hands to be free for important needs such as to hold a handrail with one hand and to guide a child up or down stairs with the other hand.

The seating provided in public settings, though often durable and economical, are invariably hard, uncomfortable, and prone to extreme temperatures. Examples include stadium chairs made from hard molded plastic, stadium benches made of unyielding metal, and park benches made of wood that have been exposed to countless seasons of sun and rain thus warping and splintering the seats into uncomfortable and dangerous surfaces.

U.S. Pat. No. 4,556,250 to Chapman et al. discloses a transportable under seat storage device for stadium type chairs that are individually separated from the each other. A handle allows a user to carry the device in a similar fashion to a suitcase. The device has a holding device that goes over the sides and front of a stadium seat bottom. A support device used to hold articles is attached underneath a seat bottom to the holding device. An optional cushion could be used on top of the holding device. An extendable metal tray, used to hold items, slides along metal rails attached to an interior surface of the support device.

U.S. Pat. No. 6,079,599 to Nordstrom et al. discloses a combination backpack and seat cushion. A sleeve member interconnects a padded member and a storage compartment. Backpack straps allow the device to be worn as a backpack and a handle allows the device to be carried with one hand. The device fits over a stadium type chair in one embodiment and fits over a stadium type bench in another embodiment. The padded member rests atop the surface of the seat and the storage compartment is located below the seating surface. Both embodiments require the use of a plurality of straps to secure the device onto the seat and to prevent the storage compartment from hanging to the ground. Keeping the storage compartment off of the ground is advantageous as the ground in stadiums is often dirty and sticky.

Unfortunately the prior art has several flaws. Such flaws include compatibly attaching only to individual, separated stadium type seats and not to bench type seats, or requiring a different embodiment to attach to each type of seat. In addition, the use of straps to secure the device onto a seat is either impossible or cumbersome. A seat may be constructed such that the seat back and seat bottom are a single unit or the seat back and seat bottom are positioned so closely together that straps cannot be used to go around the backside of a seat bottom and thus prevent the device from being secured to the seat. When the use of straps is possible, securing straps that go around the back or sides of a seat bottom places the user in an awkward position. The user must kneel down, reach above and below the seat bottom, attach the straps together and finally cinch the straps tight so the device is properly secured. The process is then repeated for one or more additional straps. If the user is unable or unwilling to secure the straps, the result is that the compartment portion of the device will sag to the ground and the weight of the under seat portion of the device will pull the device off of the seat and onto the ground.

Easy cleaning has been lacking in the prior art of combination stadium seat covers and article carriers. The prior art teaches a device having metal rails and a metal sliding tray. Machine washing for this embodiment is impractical because both the metal rails and metal sliding tray can be damaged by the motions of the agitator in the washing machine.

In view of the foregoing disadvantages there exists a need for a multi-hanging position transportable article holder for multi-type seating that can be attached without the use of straps to a stadium type chair or bench seat or virtually any seating surface that provides seat cushioning and storage of personal articles stowed underneath a seat and elevated above the ground.

SUMMARY OF THE INVENTION

The object of the preferred embodiment is to overcome these limitations and provide a new and improved multi-hanging position transportable article holder for multi-type seating. The preferred embodiment of the present invention functions both as an article holder for transport and as an easy to attach seat cover with under seat storage for articles. The preferred embodiment attaches to a stadium type chair or a bleacher type seat in a single step and without the use of straps or buckles. The preferred embodiment is generally characterized by a backpack portion, a seat cover, and one or more U-shaped apparatuses.

The backpack portion may comprise a main storage compartment, one or more ancillary storage compartments, and one or more drink holders. The backpack portion can be constructed of economical and durable material such as nylon back-coated with polyurethane waterproofing. The main storage compartment preferably has a cover that is selectively closed with a fastening means. Any ancillary storage compartment can have a padded partition to protect delicate equipment such as binoculars, a digital camera, or an MP3 player. In addition, any ancillary storage compartment can provide a headphones pass-through element. Drink holders can be located on the sides of the backpack portion and on the cover of the backpack.

The seat cover comprises an outer shell enveloping a resilient pad. In a preferred embodiment the outer shell is made of light weight nylon for greater comfort and the resilient pad is a foam rubber pad. There is a zipper across the top of the seat cover that selectively allows access to the resilient pad within.

The U-shaped apparatus joins the backpack and seat cover portions together and disposes the two portions parallel or partly parallel and opposed to each other. There is a recess between the backpack portion and the seat cover. The U-shaped apparatus is preferably a light-weight carbon based rod in a U-shape. One leg of the U-shaped apparatus is attached to the backpack portion and the other leg of the U-shaped apparatus is attached to the seat cover portion. In the preferred embodiment two U-shaped apparatuses are used to join the backpack portion and seat cover together, one on either side of the preferred embodiment An interconnecting means interconnects the backpack portion to the seat cover. The U-shaped apparatuses can be selectively secured to the preferred embodiment by the interconnecting means. Each of the flaps at the longitudinal ends of the interconnecting means wraps around the crossbar of a U-shaped apparatus and attaches to the underside of the interconnecting means to selectively secure the U-shaped apparatuses.

In a preferred embodiment the invention provides a detachable seat back cover. The seat back cover comprises a light weight nylon shell enclosing a resilient pad and a zipper to selectively allow access to the resilient pad. When the invention is used to transport articles, the seat back cover is stored in the recess between the backpack and seat cover portions. The seat back cover is removed from the recess prior to installing the device onto a seat. The user can use the seat back cover to provide additional cushioning to the seat back of a stadium type chair or to the seat of a companion.

The user can transport the preferred embodiment using either the backpack straps or handle member. When the invention is worn as a backpack, both of the user's hands are free to use for more important matters. The user can use his free hands for guidance and balance when walking down the narrow rows of a stadium or to hold a child's hand with one hand and hold onto a handrail with the other.

When at the stadium, the user need only remove the seat back cover and slide the recess over the seat bottom to attach it. The seat cover sits on top of the seat bottom and provides additional cushioning for the user and insulates the user from the extreme temperature of the seating surface. The U-shaped apparatus cantilevers the backpack portion off of the ground and parallel or partly parallel and generally adjacent to the underside of the user's seat bottom. The backpack portion is stowed away underneath the user's seat and easily accessible to the user from a seated position. The drink holder located on the cover is situated in front of the seat bottom. A drink placed in this drink holder is secured in an upright position. The preferred embodiment can also be attached to the seat back of a chair and the seat back cover can be used as a seat cushion. When the day's activity has ended, removing the preferred embodiment entails only lifting the preferred embodiment off of the seat bottom or seat back.

BRIEF DESCRIPTION OF THE DRAWINGS

The preferred embodiments of the present multi-hanging position transportable article holder for multi-type seating, illustrating its features, will now be discussed in more detail. These embodiments depict the novel and nonobvious multi-hanging position transportable article holder for multi-type seating shown in the accompanying drawings, which are for illustrative purposes only. These drawings include the following figures, in which like numerals indicate like parts.

DETAILED DESCRIPTION OF THE PREFERRED EMBODIMENTS

The preferred embodiment discloses a multi-hanging position transportable article holder for multi-type seating. A preferred embodiment of the present invention discloses a novel and nonobvious apparatus to transport articles to and from a sports stadium, the park, the beach, or the like and provides a seat cover and elevated under seat storage for articles.

Figure 1:
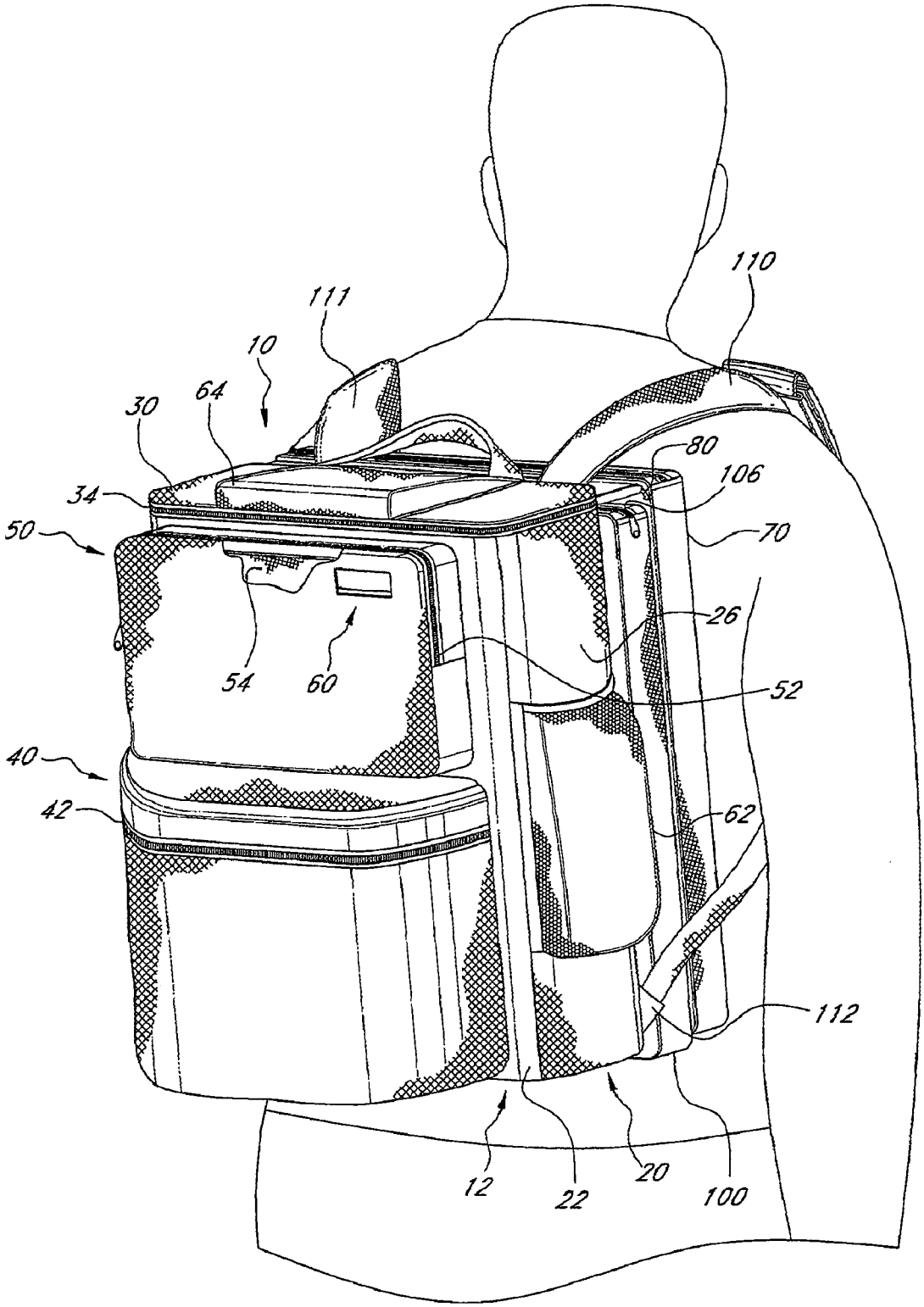
FIG. 1 is a perspective view of the preferred embodiment of a new multi-hanging position transportable article holder for multi-type seating, illustrating its place on the back of a user.

FIG. 1 illustrates the preferred embodiment of a multi-hanging position transportable article holder for multi-type seating 10 in accordance with the present invention. The preferred embodiment 10 generally comprises a backpack portion 12, a seat cover 70, and two U-shaped apparatuses 80 (shown in full in FIGS. 3 and 4A). The preferred embodiment 10 is worn with the top surface of the seat cover 70 adjacent to the user's back. In a further preferred embodiment, a seat back cover 100 is stored interposed in a recess between the backpack portion 12 and the seat cover 70 and fixedly held in place with complementary Velcro straps 79 and 108 (shown in FIGS. 3 and 6). Seat cover 70 and seat back cover 100 prevent pointed or oddly shaped items stored in the backpack portion 12 from protruding into the user's back. The backpack portion 12 comprises a main storage compartment 20, ancillary storage compartments 40, 50 and drink holders 62, 64. Backpack straps 110 and 111 allow the user to wear the invention against the user's back and keep both hands free. Handle member 120 provides an alternative means for the user to carry the preferred embodiment 10.

Figure 2:
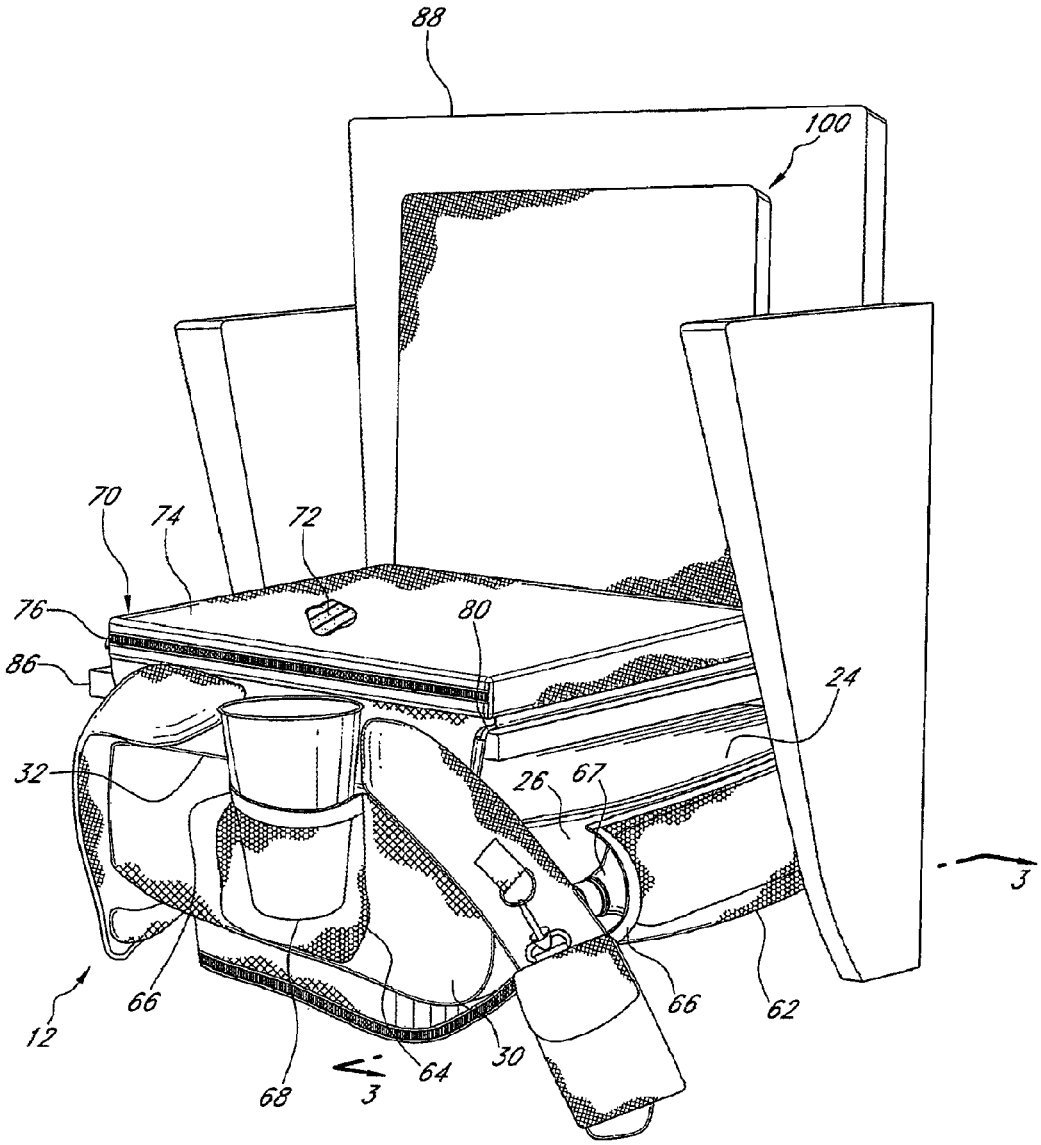
FIG. 2 is a perspective view showing the location of the preferred embodiment of FIG. 1 on the seat bottom of a stadium type chair with the seat back cover positioned on the seat back.

Referring to FIG. 2, main storage compartment 20 generally comprises a front panel 22 (shown in FIG. 1), a back panel 24, a pair of side panels 26, a bottom panel 28 (shown in FIG. 3) and a cover 30. The edges of each panel are attached to adjacent panel edges. The cover 30 is attached to the back panel 24. The panel edges and cover are attached to each other as would be known by one of skill in the art. The hinge 32 comprises the juncture of cover 30 and back panel 24 and allows the cover to flex open and close. FIG. 1 shows a zipper 34 that selectively attaches the top edges of the front 22 and side 26 panels to the unattached edges of the cover 30. Zipper 34 can be substituted with complementing Velcro strips, buttons, or any other fastening means that would be known by one of skill in the art. The panels 22, 24, 26, and 28 and the cover 30 are preferably made from a strong, easy to maintain, and economical material. Preferably the material is nylon back-coated with polyurethane waterproofing. The back coating creates a main storage compartment 20 that protects the articles stored within from external moisture or prevents the wetness of damp articles stored within, such as swimming trunks or a beach towel, from seeping onto external objects such as car seats, carpeting, or furniture.

Referring to FIG. 1, a first ancillary storage compartment 40 can be attached to the main compartment 20, in particular to front panel 22. The bottom of first storage compartment 40 can be attached to the juncture of front panel 22 and bottom panel 28. The top of the first storage compartment 40 can be located about halfway between the top and bottom of the front panel 22. Situated near the top of first storage compartment 40 is a zipper 42 that selectively allows access to an interior of first storage compartment 40. First storage compartment 40 can be divided into further storage compartments such as pen and pencil holders, a smaller storage compartment, and a zippered mesh storage compartment that provides easy visual location of stored personal items (all not shown).

Still referring to FIG. 1, a second ancillary storage compartment 50 can be attached to the main compartment 20, in particular to front panel 22. Second storage compartment 50 can be situated in between first ancillary storage compartment 40 and the top of front panel 22. A zipper 52 is located partway down the sides and across the top of second storage compartment 50. Zipper 52 is used to selectively access an interior of second storage compartment 50. The interior of second storage compartment 50 is further divided into smaller compartments by a padded divider member 54. Padded divider member 54 provides additional protection for articles stored within second storage compartment 50. Storage compartment 50 is particularly useful for holding delicate articles such as a digital camera, binoculars, or an MP3 player. In the preferred embodiment a pass through means 60 allows the user to use headphones to listen to a portable radio or MP3 player safely stored in storage compartment 50. Headphone wires are inserted through pass through means 60 and connected a portable radio or MP3 player stored within storage compartment 50.

Referring now to FIG. 2, preferred embodiment 10 may have attached to each side panel 26 a drink holder 62 and attached to cover 30 a drink holder 64. In the preferred embodiment, drink holders 62 and 64 comprise mesh material and elastic members 66. Elastic members 66 hold the drink holders 62 and 64 closed in a cinched position and securely restrain drinks inserted into drink holders 62 or 64. Drink holders 62 are suitable for holding cans or bottles 67 when the device 10 is either in a vertical position, as shown in FIG. 1, or in a horizontal position, as shown in FIG. 2. When the preferred embodiment 10 is used as a seat cover and disposed in a horizontal position, drink holder 64 is disposed in a vertical position. A drink 68 inserted into drink holder 64 is secured in an upright position, thus open top beverage containers can be safely and securely stored in drink holder 64.

Still referring to FIG. 2, the upper portion of the preferred embodiment 10 comprises a seat cover 70. A preferred embodiment of seat cover 70 comprises a resilient pad 72 enveloped by an outer shell 74. The resilient pad 72 can be made from a foam rubber resilient material, or the like, that provides cushioned support and/or thermal insulation. The outer shell 74 can be made from tough and easy to maintain material such as nylon, more particularly the outer shell 74 can be a lighter grade of nylon than main storage compartment 20 for a comfortable seating surface. A zipper 76 selectively allows access to the interior of the outer shell 74 for the insertion and removal of resilient pad 72. Other fastening means such as a Velcro or buttons can be used instead of zipper 76 to selectively access the interior of outer shell 74.

Seat cover 70 protects and buffers the user from uncomfortable features of seating surfaces such as hard materials, splinters on weathered wooden bench seats and protruding bolt heads on metal benches. Seat cover 70 has the additional benefit of insulating the user from the extreme temperatures of outdoor seating surfaces. The sun can heat seating surfaces to painfully high temperatures. Outdoor events in the cold coupled with the high thermal conductivity of metal seats or benches prevents a spectator from having a satisfactorily warm seat. The resilient foam rubber pad insulates the user from these extreme temperatures.

Figure 3:
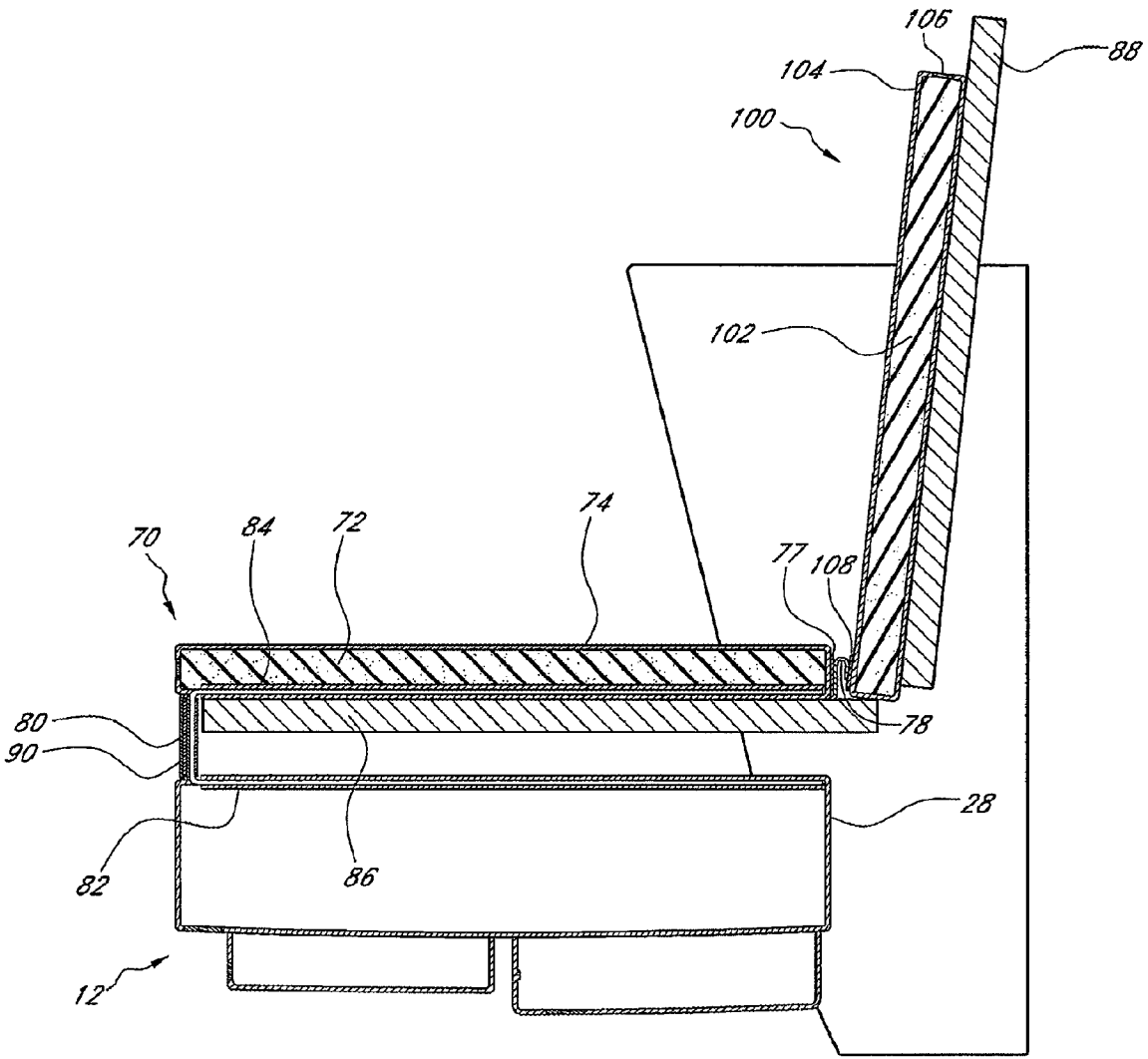
FIG. 3 is a cross-sectional view of taken along line 3-3 of FIG. 2.

Referring now to FIG. 3, U-shaped apparatus 80 is inserted into the backpack portion 20 and the seat cover 70 to join the two elements into one structural whole. One longitudinal member of a U-shaped apparatus 80 is inserted into the backpack portion and the other longitudinal member of a U-shaped apparatus 80 is inserted into the seat cover. The U-shaped apparatus 80 disposes the two portions parallel or near parallel and opposed to each other such that a recess exists between the two portions. In the preferred embodiment sleeve 82, attached to the interior of main compartment 20, and sleeve 84, attached to the interior of seat cover 70, receive and secure the longitudinal members of U-shaped apparatus 80. Sleeves 82 and 84 can be made of strong and light weight nylon material with perimeter sized to receive the longitudinal members of U-shaped apparatus. In a preferred embodiment, sleeves 82 and 84 are sewn to the interiors of the backpack portion 20 and seat cover 70, respectively. Sleeves 82 and 84 can be attached by any other means known to one of skill in the art. The two U-shaped apparatuses 80 are inserted into either side of the device 10. In the preferred embodiment, the U-shaped apparatuses 80 are removable.

Figure 4A:
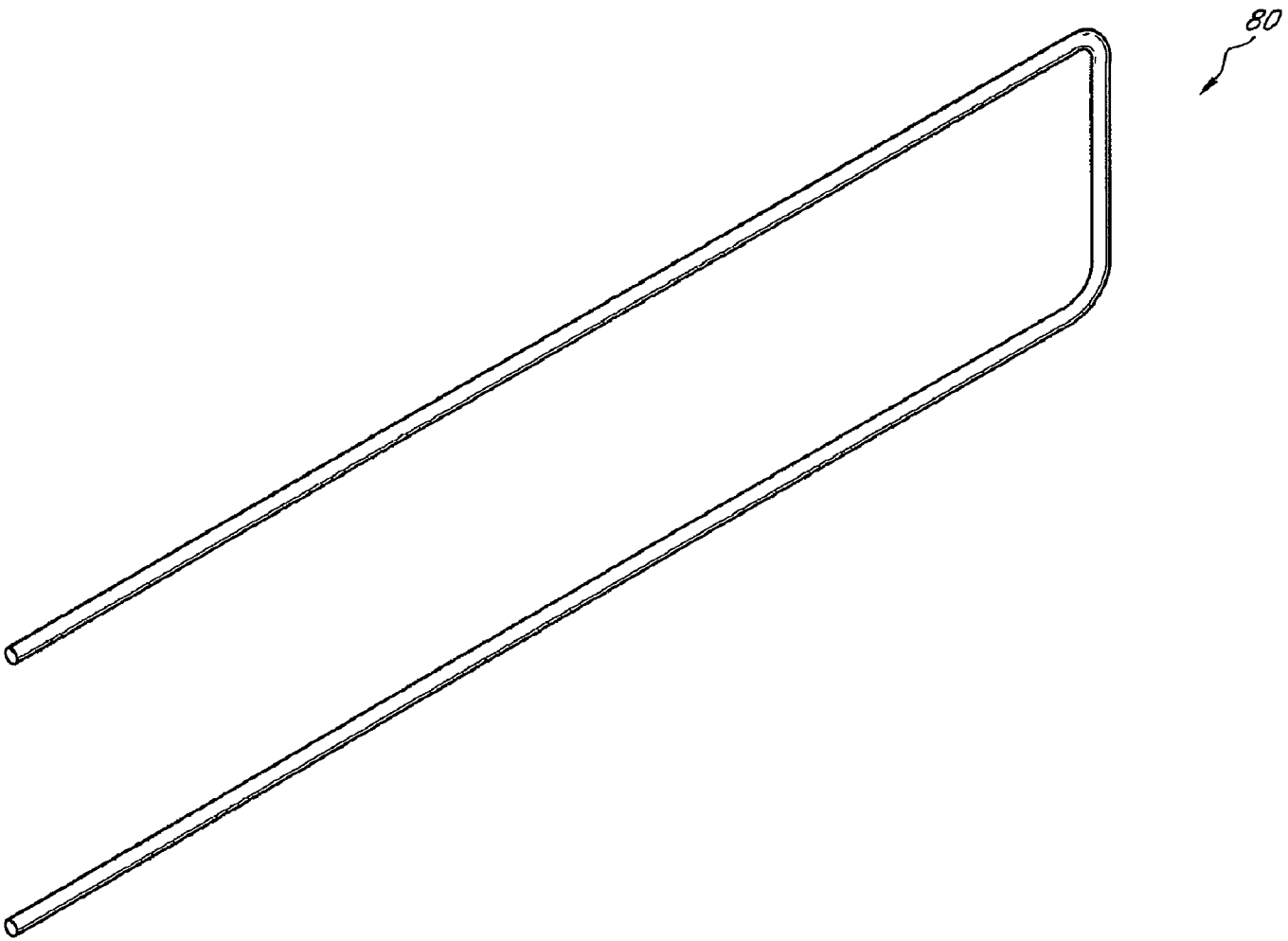
FIGS. 4A-B are perspective views showing two embodiments of a U-shaped apparatus.
Figure 4B:
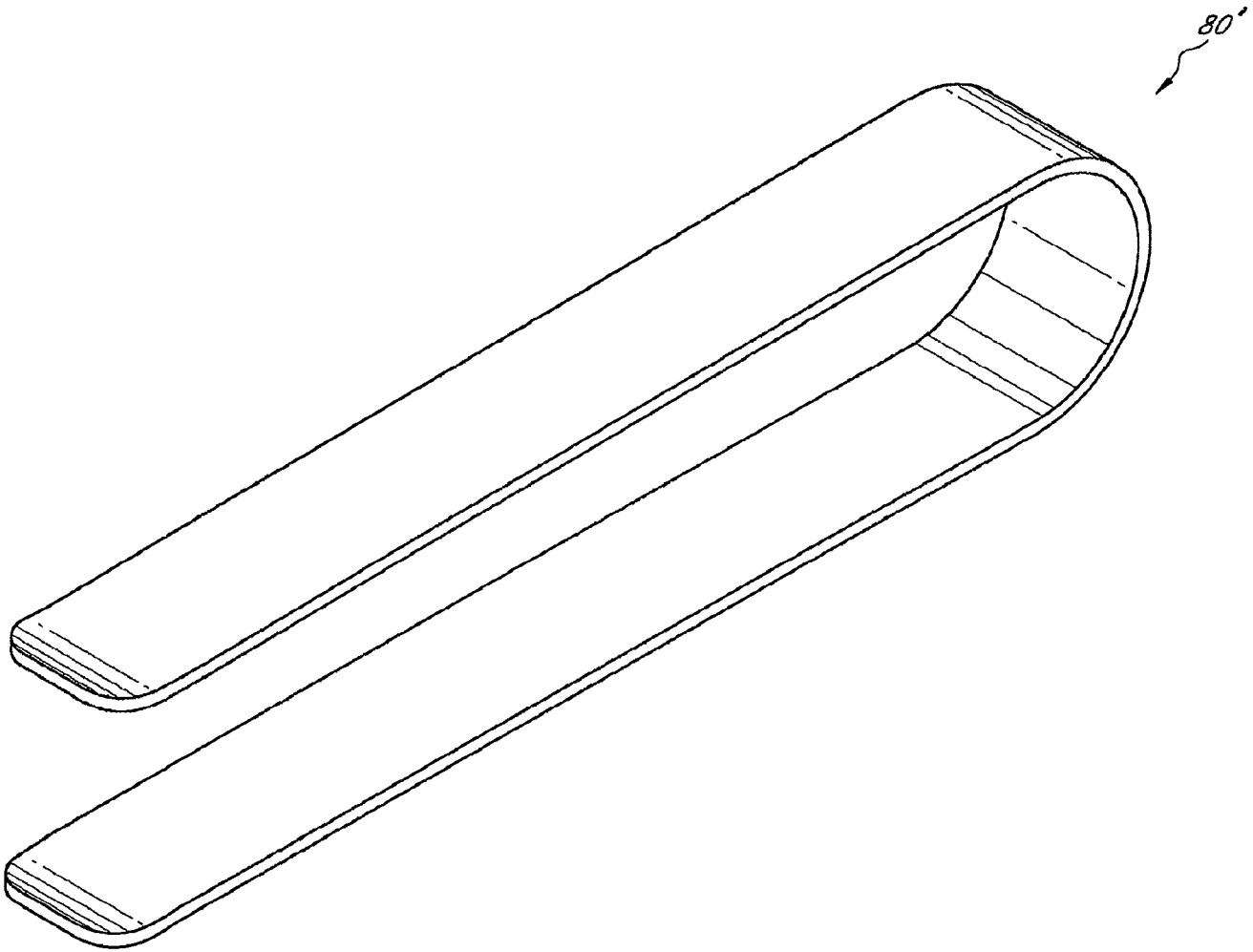

The U-shaped apparatus 80 can be made from any material that is rigid or semi-rigid, such as metal or plastic. FIGS. 4A-B show preferred embodiment of the U-shaped apparatus. FIG. 4A shows a preferred embodiment of the U-shaped apparatus 80 where it is a light-weight carbon-based rod in a U-shape. The preferred embodiment shown in FIG. 4B is a U-shaped apparatus 80' where it is a light-weight carbon-based plate with a rectangular cross-section in a U-shape.

With reference to FIGS. 2 and 3, U-shaped apparatus 80 allows the invention 10 to be attached to a stadium chair or bench seat without the use of straps. When the preferred embodiment 10 is slid over a seat bottom 86, the bottom surface of seat cover 70 and the upper inside surface of U-shaped apparatus 80 rest upon the surface of the seat bottom 86. The crossbar and the longitudinal portion of U-shaped apparatus 80 below the seat bottom cantilever the backpack portion 12 and dispose the backpack portion 12 in a parallel or partly parallel orientation adjacent to the underside of the seat bottom 86. The U-shaped apparatus 80 places the weight of backpack portion 12 and articles within along the longitudinal portion of U-shaped apparatus 80 that rests upon the surface of the seat bottom 86. The result is a seat cover that lays securely on the surface of the seat bottom 86 with an under seat storage compartment that is elevated from the ground without the use of straps.

Figure 5:
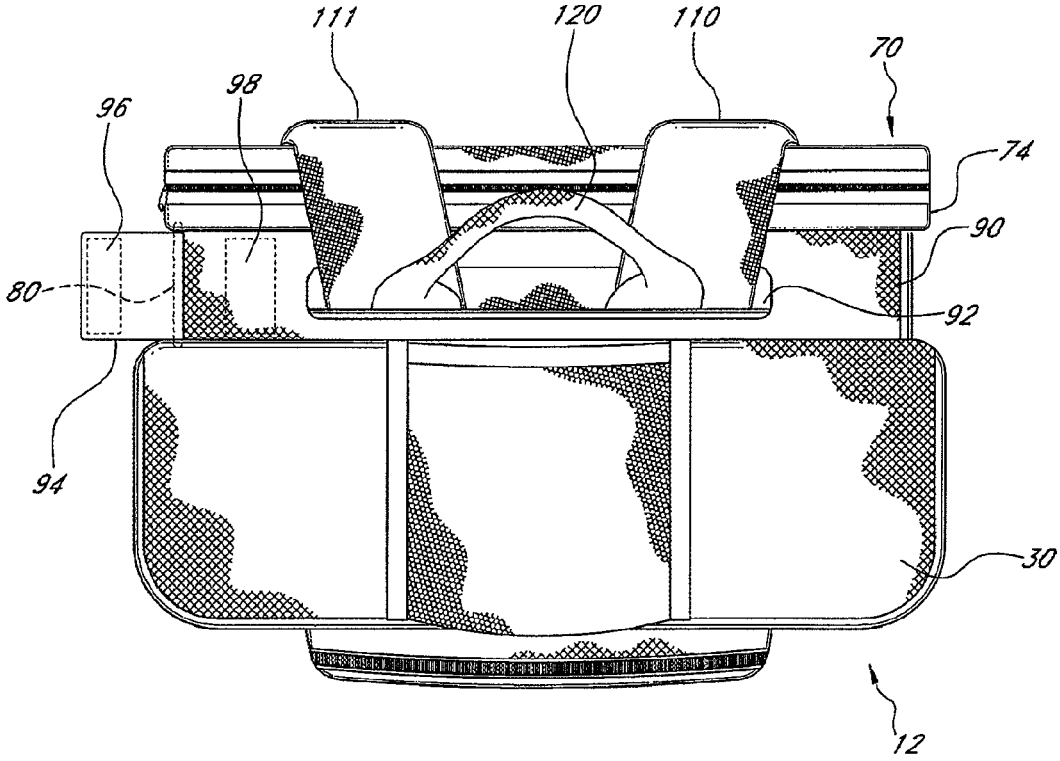
FIG. 5 is a top view illustrating the top of the preferred embodiment, in particular an interconnecting member and a restraining flap.

Referring now to FIG. 5, in the preferred embodiment the seat cover 70 is interconnected to the backpack portion 12 by an interconnecting member 90 to create a unitary whole. Interconnecting member 90 can be attached to the backpack portion 12 at a juncture of the cover 30 and back panel. The opposite edge of interconnecting member 90 is attached to an edge of seat cover 70. The interconnecting member 90 has about the same width as the crossbar portion of a U-shaped apparatus 80. In one embodiment the interconnecting member 90 has a pass-through element 92. The pass-through element 92 allows backpack straps 110 and 111 and/or a handle member 120 to pass through. The interconnecting member 90 can be comprised of an extension of the back panel 24, the cover 30, or the seat cover outer shell 74 or it can be an independent piece. Flap 94 extends from a longitudinal end of interconnecting member 90, wraps around the crossbar of a U-shaped apparatus 80 and is secured with complementing Velcro patches 96 and 98 to the underside of interconnecting member 90. Flap 94 allows for the selective securing of the U-shaped apparatus 80 to the backpack portion 20 and the seat cover 70. The U-shaped apparatus 80 is removed by detaching Velcro patches 96 and 98, unwrapping flap 94 and pulling the U-shaped apparatus 80 out of the backpack portion 12 and seat cover 70. Flap 94 is located on both longitudinal ends of interconnecting member 90, one for each U-shaped apparatus 80 in the preferred embodiment.

Referring to FIG. 3, in the preferred embodiment, the invention also comprises a seat back cover 100 to provide additional cushioning for the user's seat back 88 or a companion's seat bottom. In a preferred embodiment, seat back cover 100 comprises a resilient pad 102 enveloped by an outer shell 104. Resilient pad 102 can be made of foam rubber, or other similar material that provides cushioning and/or thermal insulation as would be known to one of skill in the art. The outer shell 104 can be made from tough and easy to maintain material such as nylon, more particularly the outer shell 104 can be a lighter grade of nylon than main storage compartment 20 for a comfortable surface. A zipper 106 allows access to the seat back resilient pad 102. Resilient pad 102 can be removed from outer shell 104 through the opening provided by zipper 106.

Figure 6:
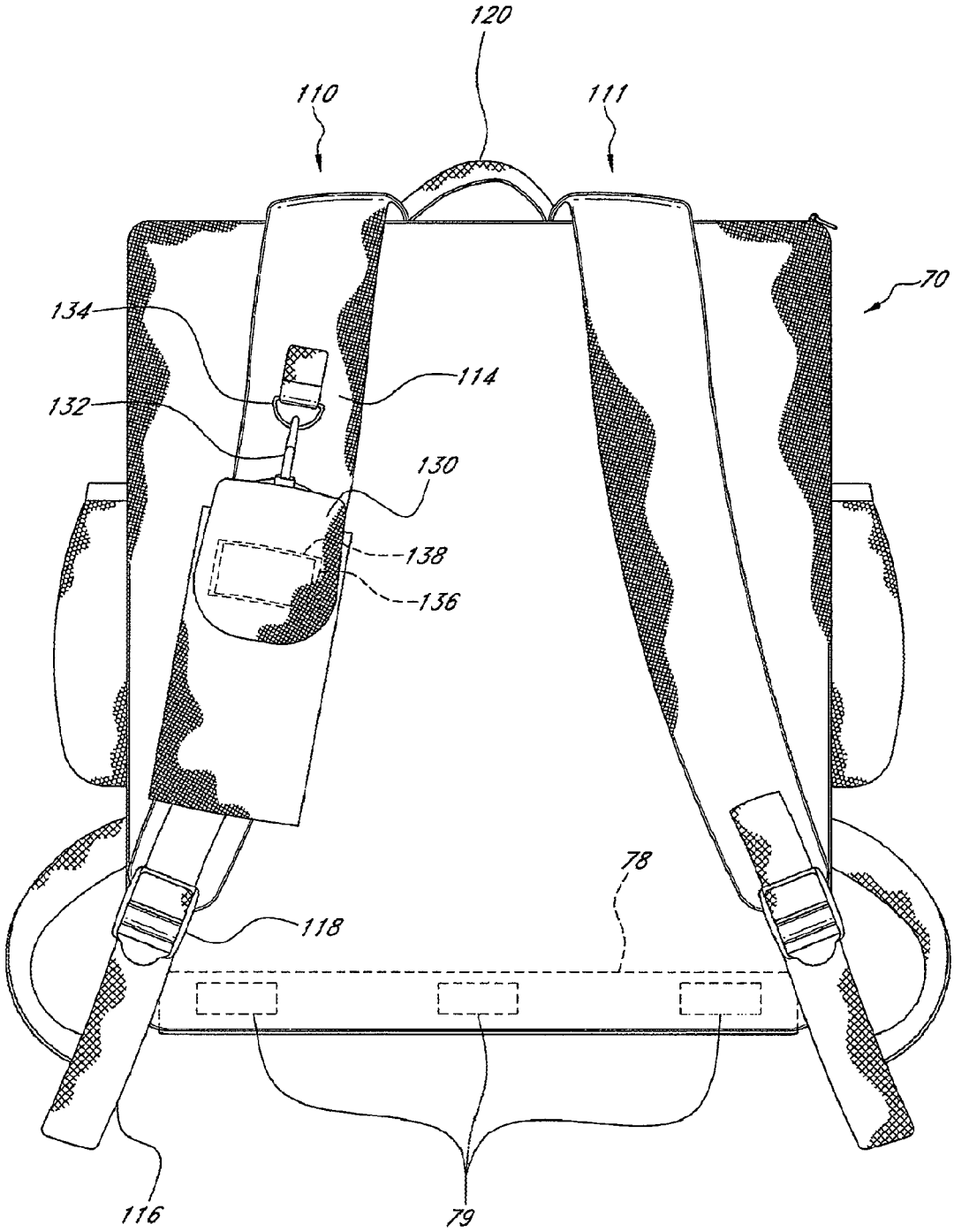
FIG. 6 is a back view illustrating the back of the preferred embodiment, in particular Velcro straps used to secure the seat back cover and backpack straps.

When the preferred embodiment 10 is configured for transport, as shown in FIG. 1, seat back cover 100 is stored interposed in the recess between backpack portion 12 and seat cover 70. FIG. 6 shows seat back cover 100 secured in place by complementary Velcro strip 108 (shown in FIG. 3) on the seat back cover 100 and Velcro strips 79 located on securing flap 78.

Referring to FIG. 6, backpack straps 110 and 111 allow the user to wear the preferred embodiment 10 against the user's back to facilitate transport of the preferred embodiment 10 and articles within. Backpack straps 110 and 111 can be comprised of a padded portion 114, a length-adjustable portion 116, and length adjustment buckles 118. In the preferred embodiment, backpack straps 110 and 111 extend from the top or near the top of back panel 24 to the junctures of the side panels 26 and back panels 24 near bottom panel 28. The backpack straps 110 and 111 are attached to the backpack portion 12 by any means known to one of skill in the art. For additional strength, the bottom ends of backpack straps 110 and 111 can be attached to triangular extension portions 112 (shown in FIG. 1) that are attached at the junctures of the back panel 24 and side panels 26 generally adjacent to the bottom panel 28. The backpack straps 110 and 111 can be attached to different points of the preferred embodiment 10 without departing from the scope or spirit of the invention.

Referring to FIG. 5, a handle member 120 is attached to the preferred embodiment of the invention. Handle member 120 is preferably attached to the back panel 24 of the backpack portion 12 by any means known to one of skill in the art. Handle member 120 allows the user to carry the invention in situations when the user would prefer not to use the backpack straps 110 and 111. The handle member 120 also facilitates sliding the preferred embodiment 10 onto a seat by allowing the user to raise the invention 10 by the handle member 120 and to place it over a seat bottom or seat back.

In reference to FIG. 6, preferred embodiment 10 can include a satellite storage compartment 130 that is attached to a front side of backpack strap 110 or 111. Storage compartment 130 can be attached to backpack strap 110 with a detachable connecting means such as a plastic swivel eye hook snap 132 and plastic D-ring 134 combination. Storage compartment 130 can be secured to backpack strap 110 with complementary Velcro pads 136 and 138. Storage compartment 130 can serve as a convenient place to store a cellular phone or portable MP3 player. When the invention 10 is in use as a seat cover, the user can retain the convenience and protection provided by storage compartment 130 by detaching it from backpack strap 110. The user can hold storage compartment 130, slip storage compartment 130 into a pocket, or hook storage compartment 130 onto a belt loop or other ringed device.

FIG. 1 illustrates a configuration of the preferred embodiment 10 that facilitates the transportation of articles to a destination. Large articles such as blankets, sweaters, and books can be stored within the main storage compartment 20. Zipper 34 selectively closes cover 30. Closure of cover 30 prevents articles from inadvertently falling out and excludes unauthorized access by others. Smaller articles can be selectively stored in the ancillary storage compartments 40 and 50. The user can use the backpack straps 110 and 111 to wear the preferred embodiment 10 over the user's back, thus freeing both of the user's hands for more important needs. Drink holders 62 and 64 provide quick and easy access to drinks even when the preferred embodiment is worn by the user. The preferred embodiment 10 can be sized to satisfy the security size regulations for article holders at almost all stadiums and venues.

Figure 7:
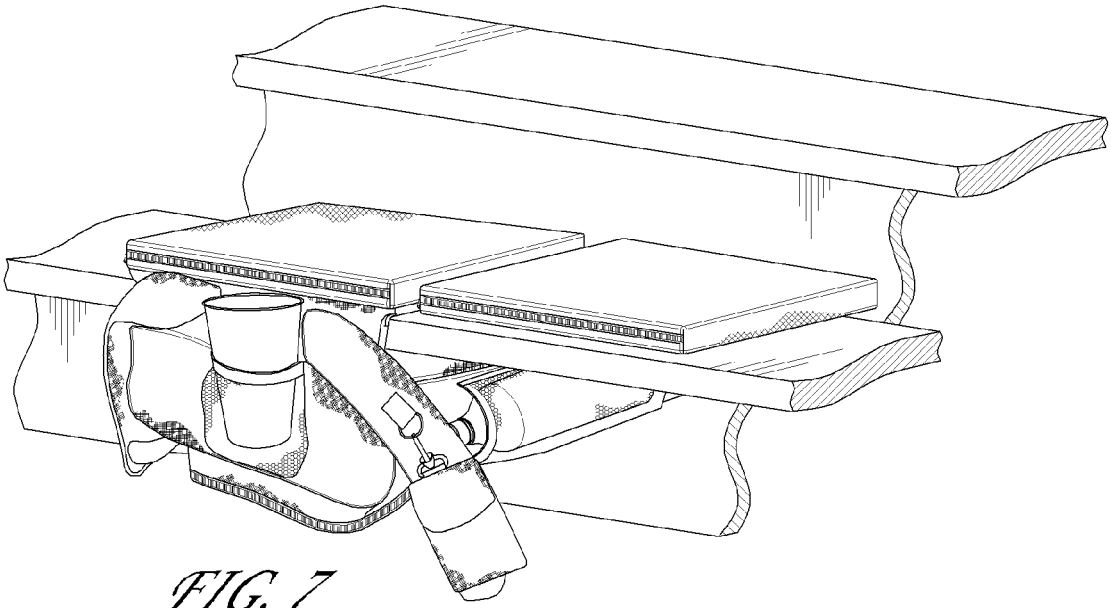
FIG. 7 is a perspective view showing the location of the preferred embodiment of FIG. 1 on the seat bottom of a stadium type bench seat with a seat back cover used as a seat bottom cushion for a companion.

Once at his or her seat, the user need only detach the seat back cover 100 and slide the preferred embodiment over the stadium chair or stadium bench. Referring now to FIGS. 2 and 3, when the preferred embodiment 10 is attached to a seat bottom 86, the front of the seat bottom 86 is adjacent to the interconnecting member 90. There are no straps, buckles or the like to secure. The user can use the seat back cover 100 to provide seat back cushioning by turning out securing flap 78 and connecting Velcro strip 108 with the complementary Velcro pads 79 (shown in FIG. 6). FIG. 7 shows the seat back cover 100 used as a seat cover for a companion.

The preferred embodiment provides several benefits to the user when attached to a seat bottom or bench. The seat cover 70 provides additional cushioning and thermal insulation that allows the user to sit more comfortably for longer periods of time. The main storage compartment 20 is located under the seat bottom and out of the way of the user. The opening to the main storage 20 compartment is conveniently located below the front of the seat bottom 86. The user, from a seated position, can reach into the main storage compartment 20 to retrieve or store articles. If the venue does not provide cup holders or if the user's cup holder is missing or broken, rather than continuously holding the beverage or placing it on the ground and risk having the drink kicked over, the user can insert the drink into drink holder 64. With the drink securely and safely stowed away, the user's hands are free to perform other activities such as using a pair of binoculars or clapping for the home team.

Figure 8:
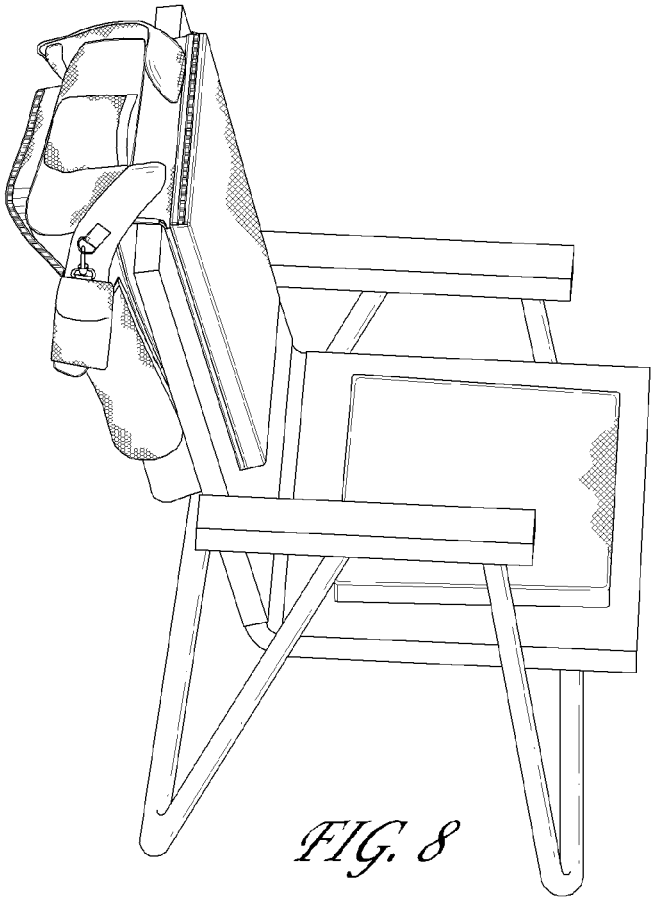
FIG. 8 is a perspective view showing the location of the preferred embodiment of FIG. 1 on the seat back of a beach style chair with a seat back cover positioned as a seat bottom cushion.

As shown in FIG. 8, the user can attach the preferred embodiment to the seat back of a chair. The invention is slid over the seat back of the chair with the backpack portion behind the seat back of a chair and the seat cushion resting against the front of the seat back. The backpack is advantageously disposed in an elevated position. A user from a standing position can easily access articles stored within the device. The device remains cleaner because it is not placed on the ground. The seat cover provides additional head and neck support for the user. If the user so desires, the seat back cover can be used to supplement the cushioning characteristic of the seat bottom.

When the fun has been had and it is time to leave, the user need only slide the invention off of the seat bottom or seat back and insert the seat back cover 100 into the recess until it is secured. Handle member 120 facilities extraction of the preferred embodiment 10 by providing a convenient place to grasp the preferred embodiment 10 and pull it up and off the seat.

Referring to FIG. 3, the preferred embodiment 10 can easily be machine washed. The user need only remove resilient pads 72 and 102 and U-shaped apparatuses 80 and place the remaining elements, namely the backpack portion 12 and outer shells 74 and 104 into a washing machine for effective cleaning without worry of damage to the preferred embodiment.

SCOPE OF THE INVENTION

The above presents a description of the best mode contemplated for carrying out the present multi-hanging position transportable article holder for multi-type seating and manner of using it, in such full, clear, concise and exact terms as to enable any person skilled in the art to which it pertains to make and use the multi-hanging position transportable article holder for multi-type seating. The multi-hanging position transportable article holder for multi-type seating is, however, susceptible to modifications and alternate constructions from that discussed above that are fully equivalent. Consequently, the multi-hanging position transportable article holder for multi-type seating is not limited to the particular embodiments disclosed. On the contrary, the present invention covers all modifications and alternate constructions coming within the spirit and scope of the multi-hanging position transportable article holder for multi-type seating as generally expressed by the following claims, which particularly claim the subject matter of the present invention.

What is claimed is:

1. A combination storage compartment and resilient pad article comprising:

a storage compartment having a front panel, a back panel, a top panel, a bottom panel, a first side panel, and a second side panel;

a resilient pad for cushioning a seating surface having a seat-facing surface, an opposing complementary surface, and lateral sides, the seat-facing surface of the resilient pad oriented substantially parallel to the back panel of the storage compartment;

an interconnecting member having a first connection at approximately the junction formed by the top and back panels of the storage compartment, and a second connection along one of the lateral sides of the resilient pad;

a substantially U-shaped semi-rigid member for engaging a seating surface having a first leg releasably engaged with the back panel of the storage compartment, a second leg releasably engaged with the seat-facing surface of the resilient pad, and a cross bar connecting the ends of the first and second legs;

a securing member for keeping the substantially U-shaped semi-rigid member releasably engaged with the back panel of the storage compartment and the seat-facing surface of the resilient pad; and at least one strap attached to the article adapted for carrying the article on an individual.

2. The article of claim 1, further comprising:

a shell for enclosing the resilient pad having an upper portion, a seat-facing portion, and lateral sides;

a first sleeve for receiving the first leg of the semi-rigid member attached to the interior of the back panel of the storage compartment;

a second sleeve for receiving the second leg of the semi-rigid member attached to the interior of the shell; and wherein the first leg of the substantially U-shaped semi-rigid member is inserted in the first sleeve and the second leg is inserted in the second sleeve.

3. The article of claim 2, wherein the securing member is a first securing member, and the substantially U-shaped semi-rigid member is a first substantially U-shaped semi-rigid member, further comprising:

a second substantially U-shaped semi-rigid member having a first leg, a second leg, and a cross bar connecting the ends of the first and second legs;

a second securing member for keeping the second substantially U-shaped semi-rigid member releasably engaged with the back panel of the storage compartment and the seat-facing surface of the resilient pad;

a third sleeve for receiving the first leg of the second semi-rigid member;

a fourth sleeve for receiving the second leg of the second semi-rigid member;

wherein the resilient pad is a semi-rectangular resilient pad having an outward facing lateral side, an opposing rearward facing lateral side, a left facing lateral side, and an opposing right facing lateral side;

the shell for enclosing the resilient pad is a semi-rectangular shell having an outward facing lateral side, an opposing rearward facing lateral side, a left facing lateral side, and an opposing right facing lateral side;

the first sleeve is attached to the interior of the storage compartment along the juncture where the back panel and first side panel meet;

the second sleeve is attached to the interior of the semi-rectangular resilient pad shell along the juncture where the seat-facing surface of the shell and the left facing lateral side meet;

the third sleeve is attached to the interior of the storage compartment along the juncture where the back panel and second side panel meet;

the fourth sleeve is attached to the interior of the semi-rectangular resilient pad shell along the juncture where the seat-facing surface of the shell and the right facing lateral side meet; and the first leg of the second semi-rigid member is inserted in the third sleeve and the second leg is inserted in the fourth sleeve.

4. The article of claim 2, wherein the resilient pad is a first resilient pad, further comprising:

a second resilient pad for covering a seat back having an outward facing surface, a seat-facing surface opposing the outward surface, and lateral sides;

a first connecting means attached to the first resilient pad along the juncture where the seat-facing surface and a lateral side of the first resilient pad meet; and a second connecting means for releasably engaging with the first connecting means attached to the second resilient pad where the outward facing surface and a lateral side meet, wherein the second resilient pad is selectively removable from the first resilient pad.

5. The article of claim 4, wherein the second resilient pad is sandwiched between the back panel of the storage compartment and the seat-facing surface of the first resilient pad and selectively removable from the sandwiched position by releasing the first connecting means from the second connecting means.

6. The article of claim 5, wherein the first connecting means is selectively moveable from a first position for holding the resilient pad between the back panel of the storage compartment and the seat-facing surface of the first resilient pad to a second position for holding the resilient pad substantially perpendicular to the first resilient pad.

7. The article of claim 2, wherein the interconnecting member is a semi-rectangular panel having a semi-rectangular pass-through element in its center, the first edge of the panel is attached along the juncture where the top panel of the storage compartment and the back panel meet, the second edge of the panel is attached along the juncture where the seat-facing surface and lateral side of the resilient pad meet.

8. The article of claim 7, wherein the strap is a first strap, further comprising:

a second strap, wherein the first strap extends through the semi-rectangular pass-through in the interconnecting member and is attached at one end to the center region at the top of the back panel of the storage compartment, and is attached at the other end near the bottom region of the first side panel; and the second strap extends through the semi-rectangular pass-through of the interconnecting member and is attached at one end to the center region at the top of the back panel of the storage compartment, and is attached at the other end near the bottom region of the second side panel.

9. The article of claim 8, further comprising:

a handle extending through the semi-rectangular hole in the interconnecting member, the handle connected at its ends to the center region at the top of the back panel of the storage compartment.

10. The article of claim 2, wherein the securing member is a flap having two ends, the first end permanently attached to the interconnecting member, the flap extending around the cross bar of the substantially U-shaped semi-rigid member, the second end releasably engaging with the interconnecting member.

11. The article of claim 2, wherein the top panel of the storage compartment is semi-rectangular with one long edge attached to the top edge of the back panel to form a hinge, the remaining edges of the top panel releasably engaged with top edges of the front panel and first and second side panels.

12. The article of claim 2, further comprising:

a pocket for holding a drink attached to the top panel of the storage compartment such that when the article is oriented horizontally with the resilient pad above the storage compartment, the mesh pocket opens upward.

13. The article of claim 2, wherein the storage compartment is a primary storage compartment, further comprising:

an ancillary storage compartment attached to the front panel of the primary storage compartment;

wherein the bottom of the ancillary storage compartment is attached at approximately the juncture of the front panel and bottom panel of the primary storage compartment, the top of the ancillary storage compartment attached to the front panel approximately halfway between the top and bottom panels; and the ancillary storage compartment being selectively openable and closeable.

14. The article of claim 2, wherein the combination storage compartment and resilient pad article is sized to satisfy the security regulations for article holders of most stadiums.

* * * * *